United States Patent [19]

Liss et al.

[11] Patent Number: 4,965,325

[45] Date of Patent: Oct. 23, 1990

[54] STAIN RESISTANT POLYMERS & TEXTILES

[75] Inventors: Theodor A. Liss; Leonard H. Beck, both of Wilmington, Del.

[73] Assignee: E. I. Du Pont de Nemours and Company, Wilmington, Del.

[21] Appl. No.: 505,343

[22] Filed: Apr. 5, 1990

Related U.S. Application Data

[60] Division of Ser. No. 124,866, Nov. 23, 1987, which is a continuation-in-part of Ser. No. 943,335, Dec. 31, 1986, abandoned, which is a continuation-in-part of Ser. No. 829,230, Feb. 14, 1986, abandoned.

[51] Int. Cl.[5] ..... C08G 8/10; C08G 8/28; C08G 8/32

[52] U.S. Cl. ..... 525/508; 528/150

[58] Field of Search ..... 525/508; 528/150

[56] References Cited

U.S. PATENT DOCUMENTS

| | | | |
|---|---|---|---|
| 3,716,521 | 2/1973 | Econong et al. | 525/508 |
| 4,501,591 | 2/1985 | Vcci et al. | 8/495 |
| 4,592,940 | 6/1986 | Blyth et al. | 428/96 |
| 4,780,099 | 10/1988 | Greschler et al. | 8/115.6 |

*Primary Examiner*—James C. Cannon

[57] ABSTRACT

Synthetic polyamide textile substrate having deposited thereon a modified polymeric sulfonated phenol-formaldehyde condensation product comprising one (a) in which 10 to 25% of the polymer units contain $SO_3(-)$ radicals and about 90 to 75% of the polymer units contain sulfone radicals and (b) in which a portion of the free hydroxyl groups thereof has been acylated or etherified, the number of said hydroxyl groups which has been acylated or etherified being sufficient to inhibit yellowing of said condensation product but insufficient to reduce materially the capacity of said condensation product to impart stain resistance to said synthetic polyamide textile substrate.

8 Claims, No Drawings

STAIN RESISTANT POLYMERS & TEXTILES

CROSS-REFERENCE

The present application is a division of application Ser. No. 124,866, filed Nov. 23, 1987, which in turn is a continuation-in-part of U.S. application Ser. No. 943,335, filed December 31, 1986, and now abandoned, which in turn is a continuation-in-part of U.S. application Ser. No. 829,230, filed February 14, 1986, and now abandoned.

FIELD OF THE INVENTION

The present invention relates to novel sulfonated phenol-formaldehyde condensation products and synthetic polyamide textile substrates treated with the condensation products so as to impart stain resistance to the polyamide substrates.

BACKGROUND OF THE INVENTION

Synthetic polyamide substrates, such as carpeting, upholstery fabric and the like, are subject to staining by a variety of agents, e.g., foods and beverages. An especially troublesome staining agent is FD&C Red Dye No. 40, commonly found in soft drink preparations. Different types of treatments have been proposed to deal with staining problems. One approach is to apply a highly fluorinated polymer to the substrate. Another is to use a composition containing a sulfonated phenol-formaldehyde condensation product.

For example, Blyth and Ucci, in U.S. Pat. No. 4,592,940, describe the preparation of stain-resistant nylon carpet by immersing the carpet in an aqueous solution of a sulfonated condensation polymer wherein at least 40% of the polymer units contain —$SO_3X$ radicals and at least 40% of the polymer units contain sulfone linkages.

On the other hand, in U.S. Pat. No. 4,501,591, Ucci and Blyth disclose continuously dyeing polyamide carpet fibers in the presence of an alkali metal meta silicate and a sulfonate phenol-formaldehyde condensation product so as to impart stain resistance to the dyed carpet. They report that in experiments in which either the alkali meta silicate or condensation product was omitted from the dyeing process, or in which silicates other than the alkali metal meta silicates were used, they failed to obtain stain-resistant carpets (Column 8, lines 4–12).

Frickenhaus et al., in U.S. Pat. No. 3,790,344, disclose a process for improving fastness to wet processing of dyeings of synthetic polyamide textile materials with anionic or cationic dye stuffs. After dyeing the textile materials, Frickenhaus et al. treated the dyed materials with condensation products prepared from 4,4'-dioxydiphenylsulphon, formaldehyde and either a phenol sulfonic acid, a naphthalene sulfonic acid, sodium sulfite, or sodium hydrogen sulfite.

However, sulfonated phenol-formaldehyde condensation products are themselves subject to discoloration; commonly they turn yellow. Yellowing problems are described by W. H. Hemmpel in a March 19, 1982 article in *America's Textiles*, entitled *Reversible Yellowing Not Finisher's Fault*. Hemmpel attributes yellowing to exposure of a phenol-based finish to nitrogen oxides and/or ultraviolet radiation. Critchley et al., *Heat Resistant Polymers; Technologically Useful Materials*, Plenum Press, N.Y. 1983, state that the thermo-oxidative stability of phenol-formaldehyde resins can be improved by etherifying or esterifying the phenolic hydroxyl group. Orito et al., in Japanese Published Patent Application Topkukai No. 48-1214, describe preparing flame-retardant filaments by (A) reacting (i) a phenol-containing compound, (ii) benzoquanamine, melamine or a methylol derivative thereof and (iii) formaldehyde; (B) forming filaments by melt-spinning the resulting polymer and (C) reacting the filaments with an esterifying or etherifying agent so as to effect color change in the filaments. In an example, soaking the filaments in acetic anhydride for five days caused their color to change from pink to pale yellow.

Meister et al., in U.K. patent specification No. 1 291 784, disclose condensation products of 4,4'-dihydroxydiphenylsulphone, diarylether sulphonic acids, and formaldehyde, and the use of such condensation products as tanning agents and as agents for improving the fastness to wet processing of dyeings obtained on synthetic polyamides with anionic and/or cationic dyestuffs. Meister et al. disclose that by preparing their condensation products in an acid pH range, leathers tanned with the condensation products showed practically no yellowing after 100 hours exposure to light in Xenotest apparatus.

BRIEF SUMMARY OF THE INVENTION

The present invention provides stain-resistant, synthetic polyamide textile substrates, and processes for their preparation. The stain-resistant substrates of this invention do not suffer from the yellowing problem to extent that prior art materials do.

DETAILED DESCRIPTION OF THE INVENTION

In accordance with the present invention, synthetic polyamide textile substrates have deposited on them modified sulfonated phenol-formaldehyde polymeric condensation products comprising one (a) in which between about 10 to 25% of the polymer units contain $SO_3(-)$ radicals and about 90 to 75% of the polymer units contain sulfone radicals and (b) in which a portion of the free hydroxyl groups thereof has been acylated or etherified. The number of said hydroxyl groups which has been acylated or etherified is sufficient to give it a materially reduced tendency to turn yellow on being exposed to nitrogen oxides or to ultraviolet light, but insufficient to reduce materially the capacity of the modified condensation product to impart stain resistance to said synthetic polyamide textile substrate. An amount of the modified condensation product is used which is sufficient to impart stain resistance to the substrate.

Modification of the condensation product can be accomplished by acylating or etherifying some of the free hydroxyl groups of the sulfonated phenol-formaldehyde condensation product. The modified condensation product can be used as made on the polyamide substrate. Preferably it is modified further by separating from it lower molecular weight materials which contribute to yellowing and which are soluble in water at a pH between about 4 and 8, and recovering and applying to polyamide substrates those portions of the modified condensation product which are insoluble in water under those conditions. As one acylates or etherifies more of those phenolic free hydroxyl groups, inhibition of yellowing will increase, but at the same time, stain resistance imparted to the textile substrate may decrease. Likewise, at lower levels of etherification or acylation, stain resistance imparted to the textile substrate will improve, but inhibition against yellowing may decrease. The extent to which the free hydroxyl groups should be acylated or etherified can be determined empirically, using the staining and yellowing tests described herein. The identity of the acylating or etherifying agent can also be a factor. Thus, the extent to which the free hydroxyl groups are acylated or etherified will vary depending upon the identity of the agent. With the preferred acylating agent, acetic anhydride, between about 50% and 80% of the phenolic hydroxyl groups in the condensation product are converted to acetoxy groups, usually between about 55 and 75%. With another acylating agent of particular interest ethylchloroformate, between about 50% and 65% of phenolic hydroxy groups are converted to ethyl carbonate groups, usually between 55% and 62%. With a preferred etherifying agent, chloroacetic acid, between about 40% and 60% of the phenolic hydroxyl groups in the condensation product are converted to carboxymethyl groups, preferably between 45% and 55%. All the foregoing percentages are determined by nuclear magnetic resonance.

The polymeric sulfonated phenol-formaldehyde condensation products which can be used as starting materials for the purposes of this invention are any of those described in the prior art as being useful as dye-resist agents or dye-fixing agents, in other words, dye-reserving agents or agents which improve wetfastness of dyeings on polyamide fibers, see e.g. the Blyth et al., Ucci et al., and Frickenhaus et al. patents cited above. Examples of commercially available condensation products suitable for the invention are the MESITOL NBS product of Mobay Chemical Corporation (a condensation product prepared from bis(4-hydroxyphenyl)-sulfone, formaldehyde, and phenol sulfonic acid; see U.S. Pat. No. 3,790,344), as well as Erional NW (formed by condensing a mixture of naphthalene monosulfonic acid, bis(hydroxyphenyl) sulfone and formaldehyde; see U.S. Pat. No. 3,716,393).

The acylated and etherified condensates of this invention can be prepared by dissolving the sulfonated phenol-formaldehyde condensate in an aqueous medium having a pH of 7 or above, preferably the latter, and then reacting the same with the acylating or etherifying agent. After acylation or etherification, between about 10 and 25% of the water-insoluble polymeric units contain $SO_3(-)$ radicals and between about 90 and 75% contain sulfone radicals. Depending upon the identity of the acylating or etherifying agent, the exact pH at which one dissolves the condensate prior to acylating or etherifying the same will vary somewhat in a manner obvious to one skilled in the art. For example, with acetic anhydride, a pH between 10 and 13 should be used, preferably at least pH 11. With dimethyl sulfate, the pH should be between 10 and 13. With ethylchloroformate, a pH of about 7 to 11 should be used, usually 7.6 to 10.4. With chloroacetic acid, the pH should be between 11 and 14, preferably between 11.5 and 13.6. Usually the pH is adjusted before adding the acylating or etherifying agent to the condensation product. For example, in a preferred embodiment, sodium hydroxide is added to water to bring its pH to about 12–13; following which acetic anhydride is added. In the alternative, one can adjust the pH of the water to 10 or higher and maintain it there by adding additional base as the acylating or etherifying agent is added.

The acylating or etherifying reaction should be run at a temperature favoring acylation or etherification, as the case may be, rather than those reactions which can produce undesired by-products. For example, there is some indication that high temperatures may favor hydrolysis of acetic anhydride rather than acylation of the phenolic-free hydroxyl groups; for the most part, room temperature or a little higher is suitable for acylation and etherification. Thus, one could use a temperature between about 15° and 40° C. When acetic anhydride is used, preferably about 20° to 30° C. When ethylchloroformate is used as the acylating agent, one could use somewhat higher temperatures, viz. about 25° to about 50° C., preferably 25° to 35° C. When the free hydroxyl groups are etherified with dimethyl sulfate, the upper limit is still higher, viz., about 20° to about 70° C., preferably 20° to 35° C. When chloroacetic acid is used as the etherifying agent, one could use a temperature between about 80° and 100° C., preferably between about 85° and 95° C.

There is no exact correspondence between the degree of acylation or etherification of the phenolic-free hydroxyls and the amount of the acylating agent or etherifying agent used in the reaction. The amount of such agent needed can be readily determined empirically without extensive experimentation, however. For example, one can use acetic anhydride in a weight ratio to the sulfonated phenol-formaldehyde condensation product in the range between 0.35:1 and 0.65:1, with a weight ratio of 0.5:1 being preferred. On the other hand, when ethylchloroformate is used as the acylating agent, a weight ratio of 0.30:1 to 0.36:1 can be used, preferably 0.33:1. Likewise, when etherification is effected with dimethyl sulfate, the weight ratio of dimethyl sulfate:-condensation product can be in the range between about 0.35:1 and 0.45:1, with 0.41:1 being preferred. When chloroacetic acid is used, the weight ratio of chloroacetic acid: condensation product can be in the range between about 0.67:1 and 1:1, preferably between about 0.8:1 and 0.9:1.

A two-phase system is usually produced in the preferred embodiment (when chloroacetic acid is used as the etherifying agent, a homogeneous system is produced). One phase consists principally of a water solution of lower molecular weight materials and the other a water-insoluble product resulting from acylation or etherifaction. The water-insoluble phase can be separated from the unwanted water solution by one or more conventional means, such as filtering, centrifuging, decanting, or the like. However, because of the physical consistency of the solids sometimes resulting from acylation or etherification, somewhat like taffy when acetic anhydride is the acylating agent, separation by such means may present some difficulties. Heating and dissolving the etherified or acylated sulfonated phenol-formaldehyde condensation product in an organic solvent provides an effective means to recover the modified condensation product in purified form. After the water-insoluble modified condensation product has been separated from the unwanted water-soluble materials which contribute to yellowing, it can be dissolved in the hydroxy-containing material. Alcohols and glycols are obvious examples of hydroxy-containing materials suitable for that purpose, e.g. ethylene glycol, 1,3-propylene glycol, 1,3-butylene glycol, and the like, preferably the former. It appears that in the presence of a hydroxy-containing material, transesterification takes place, for after standing in solution in ethylene glycol one can detect few if any acetate radicals in a condensation product which had been reacted with acetic anhydride.

The modified condensation product (viz. acylated or etherified) can be applied to dyed or undyed textile substrates. Likewise, it can be applied to such substrates in the absence of a polyfluoroorganic oil-, water-, and/or soil-repellent materials. Alternatively, such a polyfluoroorganic material can be applied to the textile substrate before or after application of the modified condensation product thereto. The quantities of modified condensation products applied to the textile substrate can be varied widely. In general, one can use between 0.5 and 5% by weight based on the weight of the textile substrate. Usually the amount will not exceed 2%. The modified condensation product can be applied, as is common in the art, at pHs ranging between 4 and 5. However, more effective exhaust deposition can be obtained at a pH as low as 2. When a pH of 2 is used, the preferred level of application to the textile substrate is about 0.6% by weight, based on the weight of the textile substrate.

The following Examples are illustrative of the invention. Unless otherwise indicated, all parts and percentages are by weight and temperatures in the Examples and Tests are in degrees Celsius. In the examples that follow, stain resistance and yellowing were measured by the techniques described below.

Stain Test

The test is used to measure the extent to which carpeting is stained by a commercial beverage composition which contains FD&C Red Dye No. 40 (an acid dye). The beverage preparation, in dry, solid form, is dissolved in deionized water so as to provide 0.1 g of FD&C Red Dye No. 40 per liter of water. Sufficient wetting agent (Du Pont Merpol SE liquid nonionic ethylene oxide condensate) is added to the dye solution to provide 0.5 g of the wetting agent per liter of dye solution. The test samples are three inch by three inch squares of undyed 25 ounce level loop nylon 6,6 which are tufted through Typar spunbonded polypropylene with no secondary backing.

The test carpet squares are placed tufted face down in a shallow pool of 40 cc of the Red Dye No. 40 stain mixture. Usually, all of the stain mixture will wick into the test squares. After a soaking period of one to two minutes, the test square is removed and placed, soaking wet, tufted side up in a shallow pan. The test square is then heated for 20 minutes at 121° in an air circulating oven. It is not necessary that the test piece be dry at the end of the heating period; in most cases it will still be wet. The test square is then rinsed in warm water, manually squeezing the samples to remove as much stain as possible in two to three minutes of rinsing. The rinsed sample is then dried at 121° for 15 minutes. If the sample is not dry after 15 minutes, it is heated at 121° for an additional 15 minutes or so much longer as is needed so as to effect drying. The degree of staining is measured by use of a Minolta Chroma Meter in the L*A*B Difference Mode with the target sample set for the unstained carpet. The "a" value is a measure of redness, with a value of 43 equal to that obtained on an untreated carpet.

Yellowing Test

Up to four of the nylon carpet samples described above are mounted face up on heavy cardboard so that they present a planar surface for exposure to ultraviolet light supplied by two Sylvania "Blacklight Blue" 15-watt, 16-inch ultraviolet lamps, catalog F15T8/BLB, fitted into a standard cantilevered desk lamp with a white reflector. The mounted samples are centered under the lamps so that the vertical distance from the lamps to the surface of each sample is one inch. The samples are exposed to the ultraviolet light continuously for 20 hours. The degree of yellowing is determined by light reflectance measurements of the exposed surface of the sample with the Minolta Chroma Meter CR-110 and its associated DP-100 data processor set for L*A*B tristimulus color difference values with the unexposed, untreated carpet samples as the target for comparison. The value of "b" is reported as the measure of yellowing with increasing positive values of "b" corresponding to increased degrees of yellowing. The Minolta Chroma Meter is used in the Hunter L*a*b color-deviation measuring mode [Richard Hunter, "Photoelectric Colorimetry with Three Filters," J. Opt. Soc. Am., 32, 509–538 (1942)]. In the measuring mode, the instrument measures the color differences between a "target" color, whose tristimulus color values have been entered into the microprocessor as a reference, and the sample color presented to the measuring head of the instrument. In examining carpet samples for yellowing and for FD&C Red Dye No. 40 staining, the "target" color entered is that of the carpet before yellowing or staining. The color reflectance of the yellowed or stained carpet is then measured with the instrument and reported as:

*E, the total color difference,

*L, the lightness value,

*a, the redness value, if positive, or greenness, if negative, and

*b, the yellowness value, if positive, or blueness, if negative.

EXAMPLE 1

MESITOL NBS (550 lbs) was dissolved at about 20° in aqueous sodium hydroxide (902.6 lbs of water and 5.4 lbs of sodium hydroxide). Additional water (1230 lbs) was added at the same temperature. Then aqueous sodium hydroxide (350 lbs of a 30% solution) was added at about the same temperature. Using cooling water to keep the temperature of the solution below 30°, acetic anhydride (280 lbs) was added. The resulting slurry of acetylated product was stirred for about one hour at 25°–30° to complete the reaction, giving a pH between about 5 and 6 (for product stability at this point, the pH should be 6 or less; if it had been greater than 6, it would have been adjusted by adding acetic acid or acetic anhydride). The slurry was heated to 55°. Agitation was discontinued and heating was continued to 70° causing the off-white precipitate to settle and soften to a taffy-like consistency. The product was cooled to below 55° and the top salt water layer (2500 lbs) was removed. NMR ($^{13}C$) showed that 73 to 79% of the phenolic hydroxyl groups in the product were acetylated. Ethylene glycol (920 lbs) was added to the taffy-like product, and heating was resumed to melt the product at about 70°. The product was dissolved in the ethylene glycol by agitating at 80°–90° for one-half to one hour, and then cooled below 55° for packing. The resulting product had a pH between 5 and 6. About 15% of its units contained $SO_3(-)$ radicals and about 85% contained sulfone radicals.

EXAMPLE 2

To a vigorously agitated solution of MESITOL NBS (150 g) in 1N sodium hydroxide (740 ml) was added acetic anhydride (75.5 g) in about four minutes at 20°-30°. The mixture was then agitated for about 30 minutes at 25°-30°. At the end of that time, the pH was 6.7. The solid which formed was filtered off on a Buchner funnel and washed with three 100 ml portions of water. The resulting filter cake was dried under vacuum at about 40° C., and the dried cake was pulverized.

EXAMPLE 3

To a vigorously agitated solution of MESITOL NBS (15 g) in 1N sodium hydroxide (74 ml) was added acetic anhydride (7.55 g) in about three minutes at 26°-37°. The mixture was then agitated for about 27 minutes at 29°-37°. At the end of that time, the pH was 7.2. The solid which formed was filtered off on a Buchner funnel and washed with three 100 ml portions of water. The resulting filter cake was dried under vacuum at about 40°, and the dried cake was pulverized.

EXAMPLE 4

To a vigorously agitated solution of MESITOL NBS (15 g) in 1N sodium hydroxide (49 ml) was added acetic anhydride (5.4 g). The temperature rose to 32°. After about 40 minutes, the pH was adjusted to 7.0 by adding acetic acid. The reaction mass was then concentrated to dryness under vacuum, and the dried cake was pulverized.

EXAMPLE 5

To a vigorously agitated solution of MESITOL NBS (15 g) in 1N NaOH (49 ml) was added dropwise dimethyl sulfate (6.2 g) over about a 25 minute period. After one hour of agitation, the mixture was heated to 70°-75° and held at that temperature for two hours. The water was then removed under vacuum at 40°, and the residue was pulverized.

EXAMPLE 6

To liquid Erional NW (40 ml) was added sufficient 1N sodium hydroxide to raise the pH to 10.4. To the mixture was added with vigorous agitation acetic anhydride (4.4 g). After two hours the water was removed under vacuum at 40°, and the dried cake was pulverized.

EXAMPLE 7

To a vigorously agitated solution of MESITOL NBS (30 g) in 2N sodium hydroxide (46 ml) was added dropwise ethyl chloroformate (10 g) at 29°-39°. The temperature was then raised to and held at 50° for about one hour. The water was then removed under vacuum, and the dried cake was pulverized.

The products of Examples 3 through 7 were applied to the nylon 6,6 carpeting described above at a level of 2% by weight of the products of those examples, based on the weight of the nylon carpeting. They were then evaluated for yellowing and staining in accordance with the test methods described above. In the yellowing test, the carpet samples were compared with a carpet sample containing Mesitol NBS powder applied at a level of 0.5% by weight, based on the weight of the carpeting. A $UV_b$ value of two or less is considered to be a meaningful improvement. In the staining test, the treated carpet samples were compared with untreated, undyed carpet samples. In practical terms (as judged visually), a material with a $KA_a$ value of 24 or less has commercial value. Control A is a carpet sample to which unmodified Mesitol NBS has been applied at a level of 0.5%. Control B is a carpet sample which is untreated for stain or yellowing resistance.

TABLE I

COLOR MEASUREMENT IN L*A*B DIFFERENCE MODE

| Example | Yellowing $UV_b$ | Staining $KA_a$ |
|---|---|---|
| 3 | 0.3 | 21.6 |
| 4 | 1.2 | 19.5 |
| 5 | 2.0 | 20.1 |
| 6 | 0.7 | 22.6 |
| 7 | 1.8 | 15.6 |
| Control A | 3.0 | |
| Control B | | 43.0 |

EXAMPLE 8

A solution of 11.5 g of NaOH pellets and 30 g of MESITOL NBS in 60 ml of water was heated to 90°. To that solution was added dropwise with agitation a solution of 25 g of sodium chloroacetate in 45 ml of water. Heating at 90° with agitation was continued for 8 hours. The resulting solution was cooled to room temperature and acidified with a 3/1 (volume/volume) water/sulfuric acid mixture to pH 7.7. Solids which separated were filtered, dry weight=27.9 g, UV Yellowing=1.9, Staining=1.4. The filtrate was acidified with the same acid solution to pH 4.4 to afford a second solids fraction, dry weight=4.1 g, UV Yellowing=1.5, Staining=1.7.

EXAMPLE 9

Best Mode

MESITOL NBS (2035 lbs) was dissolved at about 20° in aqueous 30% sodium hydroxide (1360 lbs). Additional water (8157 lbs) was added at the same temperature. Using cooling water to keep the temperature of the solution below 40°, acetic anhydride (1077 lbs) was added. The resulting slurry of acetylated product was stirred for about one hour at 25°-30° to complete the reaction, giving a pH of about 5.7 (for product stability at this point, the pH should be 6 or less; if it had been greater than 6, it would have been adjusted by adding acetic acid or acetic anhydride). The slurry was heated to 55°. Agitation was discontinued and heating was continued to 70° causing the off-white precipitate to settle and soften to a taffy-like consistency. The product was cooled to below 55° and the top salt water layer (9100 lbs) was removed. Ethylene glycol (2975 lbs) was added to the taffy-like product, and heating was resumed to melt the product at about 70°. The product was dissolved in the ethylene glycol by agitating at 80°-90° for one-half to one hour, and then cooled below 55° for packing. The resulting product had a pH of about 5.3, Staining=0.9, UV Yellowing=1.4.

We claim:

1. A process for preparing a modified polymeric sulfonated phenol-formaldehyde condensation product having a reduced tendency to turn yellow and which will provide stain resistance to synthetic polyamide textile substrates which comprises acylating or etherifying a portion of the free hydroxyl groups in a sulfonated phenol-formaldehyde condensation product at a pH between about 7 and 13 to provide a water-insoluble modified polymeric sulfonated phenol-formaldehyde condensation product comprising one in which (a) about 10 to 25% of the polymer units contain $SO_3(-)$ radicals and about 90 to 75% of the polymer units contain sulfone radicals and (b) a portion of the free hydroxyl groups thereof has been acylated or etherified, the number of said hydroxyl groups which has been acylated or etherified being sufficient to inhibit yellowing of said condensation product but insufficient to reduce materially the capacity of said condensation product to impart stain resistance to a synthetic polyamide textile substrate.

2. The process of claim 1 further characterized in that following acylation or etherification, said water-insoluble etherified or acylated condensation product is separated from the aqueous layer that forms in the etherification or acylation reaction.

3. The process of claim 2 in which said etherified or acylated condensation product is heated and dissolved in a hydroxy-containing material.

4. The process of claim 3 wherein said portion of said free hydroxyl groups has been acylated with acetic anhydride.

5. The process of claim 4 wherein said hydroxy-containing material is ethylene glycol.

6. The process of claim 3 wherein said portion of said free hydroxy groups has been acylated with ethyl chloroformate.

7. The process of claim 3 wherein said portion of said free hydroxyl groups has been etherified with dimethylsulfate.

8. The process of claim 3 wherein said portion of said free hydroxyl groups has been etherified with chloroacetic acid.

* * * * *